United States Patent [19]

DeLaney

[11] Patent Number: 4,690,654

[45] Date of Patent: Sep. 1, 1987

[54] TOY VEHICLE CARRYING CASE AND LAUNCHER

[75] Inventor: George E. DeLaney, Hanover Park, Ill.

[73] Assignee: Craft House Corporation, Toledo, Ohio

[21] Appl. No.: 798,924

[22] Filed: Nov. 18, 1985

[51] Int. Cl.[4] ..... A63H 29/00

[52] U.S. Cl. ..... 446/28; 446/75; 446/430; 124/16; 124/26

[58] Field of Search ..... 446/26, 28, 75, 71, 446/429, 430, 63–65, 473; 124/16, 17, 26; 206/216

[56] References Cited

U.S. PATENT DOCUMENTS

| | | | |
|---|---|---|---|
| 3,233,357 | 2/1966 | Lent | 124/26 X |
| 3,693,282 | 9/1972 | Adicks et al. | 446/430 |
| 4,364,104 | 12/1982 | Holahan | 446/473 X |
| 4,433,504 | 2/1984 | Terui | 446/429 X |
| 4,473,969 | 10/1984 | Wilson | 446/26 |

*Primary Examiner*—Mickey Yu

*Attorney, Agent, or Firm*—Irvin L. Groh

[57] ABSTRACT

A toy vehicle carrying case and launcher having a clip for carrying on the belt of the user. The clip retracts as the case is placed on a surface for launching. The vehicle and launcher are completely enclosed in the carrying mode. A ready button releases a vehicle carrier to swing out into a launching mode. A firing button launches the vehicle and is operative only when the carrier is in its ready position.

24 Claims, 7 Drawing Figures

TOY VEHICLE CARRYING CASE AND LAUNCHER

This invention relates to model cars, and more particularly to a carrying case and launcher for a single racing vehicle.

There are a number of toy vehicle launchers which release a toy car by gravity or propel the car onto a track layout. This type of launcher or accelerator is placed on a surface for repetitive use at one location.

Another type of vehicle and launcher which is carried around in the user's hand involves the use of a tube within the vehicle which contains a propulsion spring which is compressed by the insertion of a rod or key type member. This type of unit provides no positive means for guiding the car and is often misfired or misdirected.

Neither of the foregoing launching devices provides a hanger or carrying device in combination with a power launcher.

It is, therefore, an object of this invention to provide a combined carrier and launching device for a toy vehicle.

It is another object to provide a closure and launcher for a toy vehicle which can be easily carried on the person of the user.

It is still another object of this invention to provide a carrying closure and launcher for a toy vehicle in which the launcher springs out from the closure with the toy vehicle in readiness for launching.

Another important object of this invention is to provide a closure and launcher which has means for directing the vehicle in a straight line as it is projected from the launcher.

It is a still further object of this invention to provide a closure and launcher which cannot be used or even armed to fire any object other than the intended vehicle.

The foregoing objects and other objectives have been accomplished in a carrying case and launcher which is easily hand held, being of the order of less than five inches long and two inches wide in the carrying mode. An elongated housing forms the main walls of the carrying closure and has a vehicle carrier mounted for movement relative to the housing from a first position in which the carrier is confined within the housing to function therewith as the carrying case or closure to a second position in which the carrier extends from the housing presenting an open end for launching the toy vehicle.

In the preferred form, the vehicle carrier is pivotably connected at one end of the housing for rotation from a first, closure, to a second, launching, position. A ready spring is located with its axis at the pivotable connection operatively connected between the carrier and the housing for effecting the rotation. A ready button release lever has a ready button at one end which when depressed releases the carrier relative to the housing allowing the ready spring to rotate the carrier from the first confined position to the second open position. Preferably the second open position is approximately 180 degrees from the first position which is established by cooperating stop means on the housing and the carrier. This aligns the carrier with the housing through the pivotable connection.

When the carrier is rotated to move it from its second launching position to return it to its confined or storage position, the ready spring will be cocked and the ready button release lever will be operatively realigned. A pivot lock spring element on the carrier coacts with the lock abutment on the housing to retain the carrier locked in its first position. Depression of the ready button depresses the lock spring disengaging it from the lock abutment which allows the ready spring to rotate the carrier from the confined first position to the second launching position.

A launching device is operatively connected to the carrier having an impact panel, the forward side of which engages the vehicle. The operative connection of the launching device to the carrier includes a pair of slide members projecting from the rear side of the impact panel and engaging stationary sliders on the carrier. A launching spring is located between the slide members bearing against the rear side of the impact panel and the carrier.

Means are provided for aligning the vehicle on the carrier in an operative relationship to the launching device. Preferably this takes the form of an alignment bar extending from the forward side of the impact panel. The vehicle has wall means forming a longitudinally extending passage for receiving the alignment bar as the vehicle is loaded on the carrier. As the vehicle is pushed over the alignment bar and against the impact panel the launching spring is compressed to provide the motive of force for propelling the vehicle by the movement of the launching device relative to the carrier.

A firing button is located on the axis of rotation of the pivotable connection and the button is movable against the axial compression force of the ready spring to release the launching device. A firing lever is mounted on the carrier, the lever having a catch which engages a depression in the bottom rear of the vehicle as the vehicle is loaded on the carrier. This clutch holds the vehicle against the impact panel of the launching device which in turn maintains the launching spring in a compressed or cocked position.

Depression of the firing button pivots the firing lever releasing the catch from the vehicle which in turn releases the launching device allowing the launching spring to propel the vehicle from the carrier.

A longitudinally extending projection on the firing button has a limited circumferential extend which will make contact with the firing lever only when the carrier is in the second, open launching position. This acts as a safety device preventing premature firing on the vehicle, for example, when it is in its confined storage position.

This same projection on the firing button engages one end of the ready spring and an abutment surface on the firing button engages an abutment surface on the housing so that as the carrier is rotated from its second open launching position to the first confined storage position, the ready spring is wound or cocked.

The closure and launcher housing further includes a retractable belt clip which is mounted on the bottom surface of the housing at the end opposite to the pivotable connection so that as the housing is pressed against a roadway or launching surface, the clip will retract against the housing. The belt clip provides a "quick-draw" availability of the toy to the user.

From an overall operational and appearance standpoint, the vehicle carrying closure and launcher presents and elongate housing having a top and bottom wall. The retractable belt clip is mounted on the bottom wall so that its attachment to the user's belt will not cause accidental depressing of the ready button to advance the carrier to the launch position. The ready and firing buttons are located on the top wall of the housing and are in full view on the belt of the user.

In competition, the unit can be whipped from the user's belt, the housing serving as a handle or grip, with a touch of the ready button, the carrier flicks the car into launch position. With a continuing arm movement, the housing is pressed against the racing surface automatically retracting the belt clip. With a push of the firing button, the firing spring propels the vehicle forward from the impact surface of the launcher guided in a straight line by the alignment bar. In starting over, the car is snapped back into its launching platform, the carrier, inserting the alignment bar into the vehicle body and cocking the firing spring. As the launching platform is folded back into the handle, the ready spring is cocked ready for another race and the unit is returned to the belt by pulling out the retractable clip.

The objects of this invention are accomplished by the embodiment disclosed in the following description and illustrated in the drawing in which.

Figure 5:
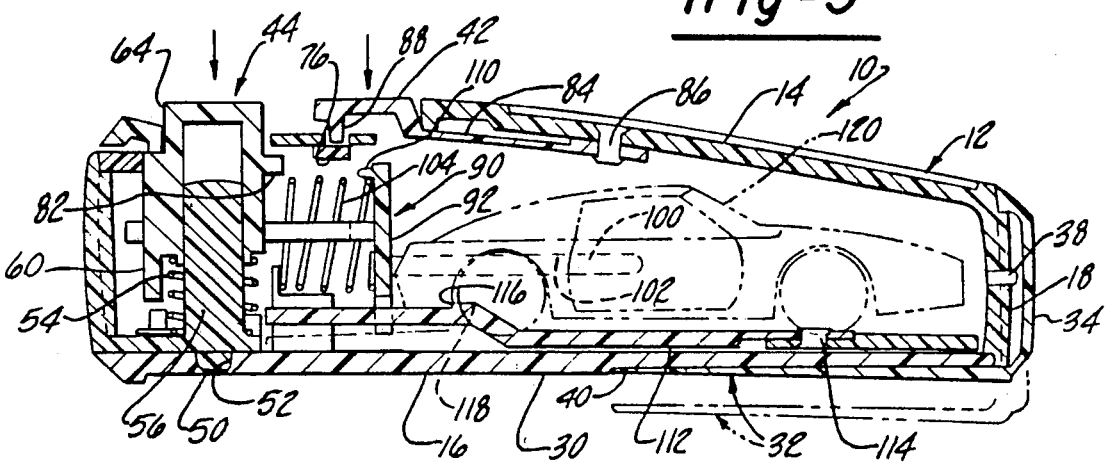
FIG. 5 is a section view taken along line 5—5 of FIG. 1 showing details of the launching carrier and the attachment of the vehicle to the carrier in its ready position.
Figure 6:
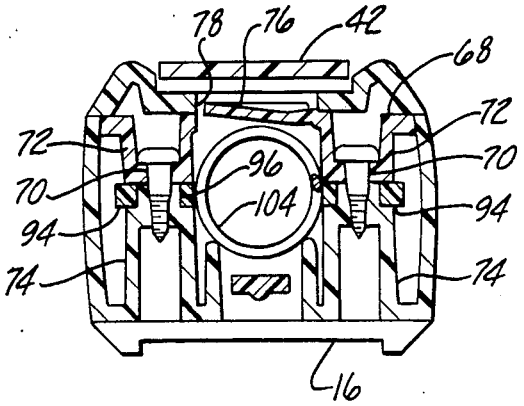
FIG. 6 is a sectional view taken along line 6—6 of FIG. 1 showing the details of the launching slide members.
Figure 7:
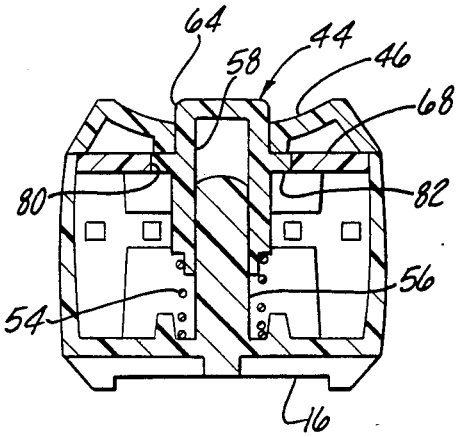
FIG. 7 is a sectional view taken along line 7—7 of FIG. 1 showing the details of the firing button.

The carrying case and launcher 10 of the present invention includes a housing 12 molded in a generally U-shaped configuration with top wall 14, bottom wall 16, rear wall 18 and partial side wall 20. Carrier 22 is mounted for movement relative to housing 12, and with its side wall 24, end wall 26 and partial side wall 28, combines the housing 12 to form unitary carrying case or closure 30. An L-shaped belt clip 32 is mounted with its short face 34 mounted to housing end wall 18 between slide members 36. Rivet 38 extends through rear wall 18 to limit the outward sliding motion of the clip relative to the bottom wall 16 of housing 12. FIG. 5 shows the clip pushed into recess 40 in bottom wall 16 as it would appear when the unit has been pressed against a racing surface for launching. FIG. 5 also shows the clip 32 in phantom, extended from the closure and launcher for attachment to the user's belt. Ready button 42 and firing button 44 are prominently visible on top wall 14 but are contained in cavity area 46 to reduce the possibility of accidental projection of carrier 22 by contact with ready button 42. As will be explained later, pushing firing button 44 will not launch the vehicle unless the carrier is in its fully extended launching position.

Carrier 22 is pivotably mounted to housing 12 along pivot line 48, being held at its lower end by carrier boss 50 in housing aperture 52 and its upper end by firing button 44 in housing aperture 66. Ready spring 54 for supplying the motive power for rotation of carrier 22 out of housing 12 is mounted on pivot line 48 over carrier post 56. Firing button 44 has a hollow cylindrical portion 58 which fits over post 56 for rotation thereon. The firing button 44 also has a vertically extending projection 60 which engages hook end 62 of spring 54. Button 44 is rectangularly shaped at its upper end 64 to be received in rectangular cutout 66 on the top wall 14 of housing 12. This provides cooperating abutment surfaces allowing ready spring 54 to provide the motive power for rotating carrier 22 relative to housing 12.

Carrier cap 68 is affixed to carrier body 22 by screws 70 which pass through bosses 72 into carrier post 74. Cap 68 provides a pivot lock spring 76 molded integral therewith which acts against a lock abutment 78 on housing 12 to lock the carrier in a closed position providing the carrying case mode. Carrier cap 68 also has a round aperture receiving an alignment shoulder 82 on button 44.

Ready button 42 is located on one end of ready lever 84 which is attached to the underside of housing top wall 14 by eyelet 86. Projection 88 extends from the button end of ready lever 84 and contacts pivot lock spring 76 when the ready button is depressed to release carriage 22 for rotation out of housing 12.

Launching device 90 is mounted for linear motion on carrier 22. Launching device 90 has an impact plate 92 which contacts the rear end of the toy vehicle to impart the propelling force for launching. Slide members 94 project from the rear side of impact plate 92 and are affixed to post 74 by screws 70, the upper ends 96 of post 74 acting as sliders which ride in slots 98 of slide members 94.

In order to optimize the propulsion force used in launching the vehicle, it is necessary to guide the vehicle so that it is projected in a straight line. To accomplish this, rectangular cross-section alignment bar 100 extends from the forward face of impact plate 92. The vehicle has wall means forming a longitudinally extending passage 102 receiving the alignment bar as the vehicle is loaded into the carrier.

Launching spring 104 is located in carrier 22 between slide members 94 to act between the rear end of the impact plate 92 and the carrier body. Guide members 106 and 108 position the spring 104 relative to the carrier while projection 110 positions the spring relative to the impact plate. Firing lever 112 is mounted at its forward end by eyelet 114 to carrier 22 and extends rearwardly to firing button 44. Catch 116 extends upwardly from firing lever 112 forward of impact plate 92. Catch 116 engages in depression 118 at the rear end of toy vehicle 120 to retain the vehicle in launching position. With the carrier 22 rotated to its launching position, the projection 60 on firing button 44 is vertically in line with the free end of firing lever 112. As the firing button 44 is depressed against the top of ready spring 54, the projection 60 engages the firing lever to release catch 116 from the vehicle depression 118 allowing the launcher 90 to project the vehicle with the expansion of launching spring 104.

Figure 1:
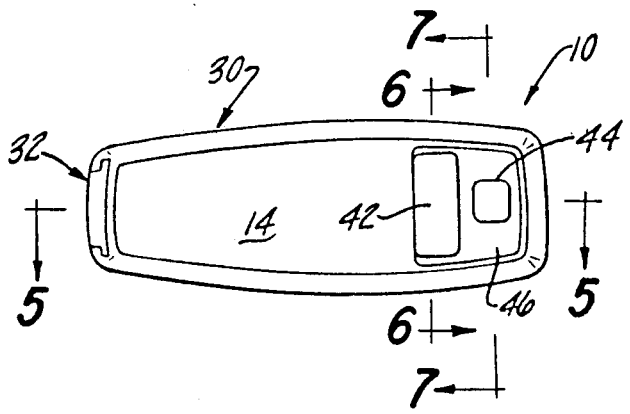
FIG. 1 is a plan view of the closure and launcher of this invention in its first position with the launching carrier confined within the hanger housing to function as a carrying case.
Figure 2:
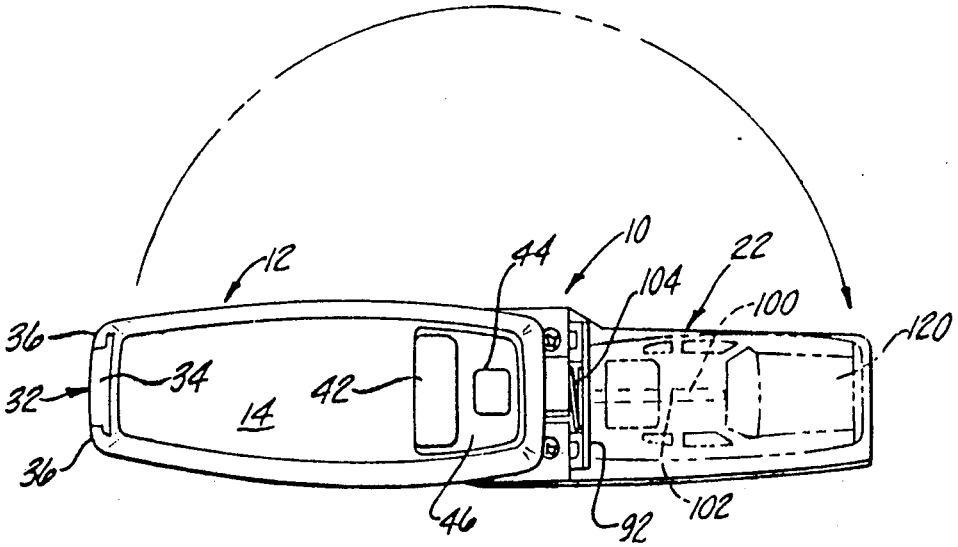
FIG. 2 is a plan view showing the carrier in its second ready position for launching the vehicle.
Figure 3:
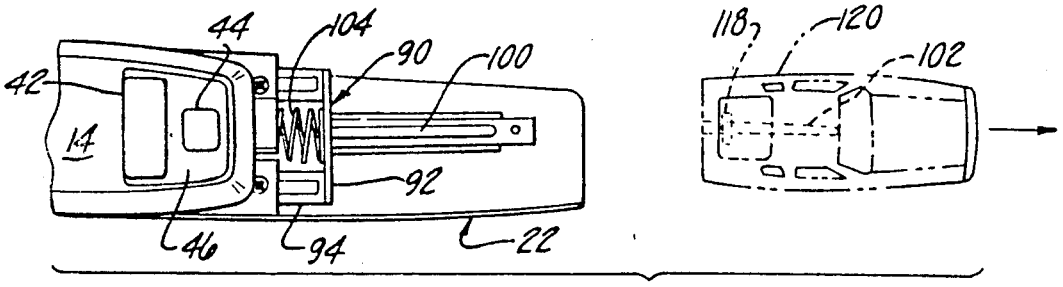
FIG. 3 is a partial plan view showing the toy vehicle as it has been launched from the carrier.
Figure 4:
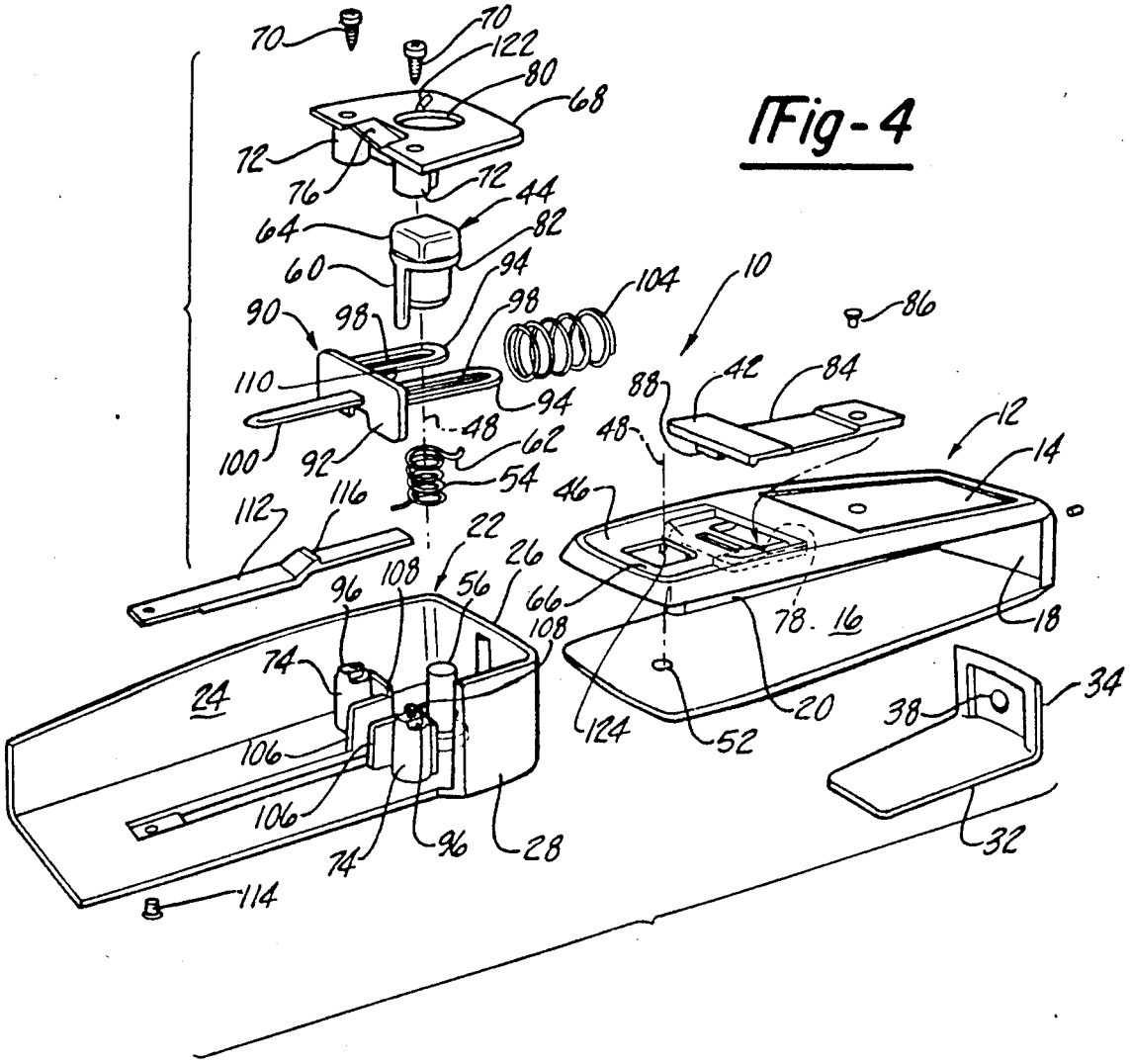
FIG. 4 is an exploded perspective view showing the carrier in the ready position of FIG. 2.

In operation, with the carrier 22 in its open position, in line with housing 12 through the pivot axis 48, the toy vehicle 120 is loaded onto carrier 22 by inserting the alignment bar 100 in the rear of the vehicle into the longitudinally extending passage 102 pushing the rear of the vehicle against impact plate 92 to compress launching spring 104 until vehicle depression 118 engages catch 116 of firing lever 112. This will hold the launching spring 104 in its cocked position and the vehicle in readiness for launching. As the carrier 22 is rotated into housing 12, it swings about pivot axis 48, and the coaction of firing button projection 60 with the end 62 of ready spring 54 will wind the spring to its fully cocked condition when the pivot lock spring 76 on the carrier engages the pivot lock abutment 78 on housing 12 to hold the carrier in its locked position for carrying. The unit may be mounted on the users belt by pushing clip 32 outwardly from housing bottom 16. When the launcher is retrieved from the belt for use, the housing is grasped in the user's hand with the thumb extending over the ready button area. When the ready button 42 is depressed, projection 88 contacts pivot lock spring 76 to release it from abutment 78 allowing the carrier to rotate outwardly to its launching position. Stop 122 on carrier cap 68 engages stop 124 on the inside of housing top wall 14 to stop the carrier in alignment with the housing. As the housing is placed on a racing surface, the belt clip 32 automatically retracts into recess 40 in the bottom 16 of housing 12. Depression of firing button 44 causes the projection 60 to contact the firing lever 112 moving the latch 116 out of the vehicle cavity 118 allowing the impact plate 92 to propel the vehicle 120 forwardly by the force of launching spring 104. Alignment bar 100 serves to keep the vehicle moving in a straight path as it is catapulted from the launcher as seen in FIG. 3. The vehicle can be again reloaded onto the carrier in the manner set forth above.

It will be readily apparent that modifications can be made to the preferred embodiment without departing from the scope of the appended claims. For example, the carrier 22 may be projected linearly out of the housing 12 to its as ready launch position.

The embodiments of the invention in which an exclusive property or privilege is claimed are defined as follows:

1. A toy vehicle carrying closure and launcher comprising, in combination:

an elongate housing having a top and bottom wall;

a retractable belt clip mounted on said housing for carrying said closure on the user's belt and retracting flush with said housing bottom wall when the launcher is placed on a surface for launching;

a vehicle carrier mounted to said housing for movement from a first position in which the carrier is confined within said housing to function therewith as a carrying closure to a second position presenting an open end for launching said vehicle;

ready means on said top wall for actuating movement of said carrier from said first to said second launching position;

a launching device operatively connected to said carrier; and firing means on said top wall for causing said launching device to propel said vehicle.

2. A toy vehicle carrying closure and launcher comprising, in combination:

an elongated housing;

a vehicle carrier mounted to said housing for movement from a first position in which the carrier is confined within said housing to function therewith as a carrying closure to a second position presenting an open end for launching said vehicle;

means for effecting movement of said carrier from said first to said second positions including a ready spring providing the motive power;

a release lever;

a ready button to move said release lever upon depression of said button, releasing said carrier and allowing said ready spring to effect movement of said carrier from said first confined position to said second open position;

a launching device operatively connected to said carrier;

means for aligning said vehicle on said carrier in operative relationship to said launching device; and means for releasing and propelling said vehicle from said carrier by said launching device.

3. The closure and launcher of claim 2 wherein as said carrier is moved from said second, open launching position to said first confined position, said ready spring will be cocked and said ready button release lever will be operatively repositioned.

4. A toy vehicle carrying closure and launcher comprising, in combination:

an elongated housing;

a vehicle carrier mounted to said housing for movement from a first position in which the carrier is confined within said housing to function therewith as a carrying closure to a second position presenting an open end for launching said vehicle;

means for effecting movement of said carrier from said first to said second positions;

a launching device operatively connected to said carrier;

means for aligning said vehicle on said carrier in operative relationship to said launching device; and means for releasing and propelling said vehicle from said carrier by said launching device including a launching spring and a firing button which upon depression of said firing button releases said launching device allowing said launching spring to propel said vehicle.

5. The closure and launcher of claim 1 further including a safety device which allows said firing button to release said launching device to propel said vehicle only when said carrier is in said second open position.

6. The closure and launcher of claim 1 wherein as said vehicle is loaded on said carrier in said second open carrier position with said alignment means positioning the vehicle relative to said launching device, said launching spring is cocked for actuation by said firing button.

7. The closure and launcher of claim 6 wherein said alignment means includes an alignment bar attached to said launching device extending toward the open end of said carrier and said vehicle has a wall means forming a longitudinally extending passageway for receiving said alignment bar as said vehicle is loaded on said carrier.

8. The closure and launcher of claim 7 wherein said alignment bar has a generally rectangular width cross-section.

9. The closure and launcher of claim 6 further comprising a catch which engages said vehicle when said vehicle is loaded on said carrier, holding said launching device and maintaining said launching spring in a cocked position, and actuation of said firing button releases said catch from said vehicle.

10. A toy vehicle carrying closure and launcher comprising, in combination:

an elongate housing;

a vehicle carrier pivotably connected at one end of said housing for rotation from a first position in which the carrier is contained within said housing to function therewith as a carrying closure to a second position presenting an open end for launching said vehicle;

means for effecting rotation of said carrier from said first to said second positions;

a launching device operatively connected to said carrier;

means for aligning said vehicle on said carrier in operative relationship to said launching device; and means for releasing and propelling said vehicle from said carrier by said launching device.

11. The closure and launching device of claim 10 further comprising stop means on said housing and carrier to establish said second open position at approximately 180° from said first confined position, aligning said carrier with said housing through said pivotable connection.

12. The closure and launcher of claim 10 wherein the means for releasing and propelling said vehicle includes a launching spring and a firing button which upon depression of said firing button releases said launching device allowing said launching spring to propel said vehicle.

13. The closure and launcher of claim 12 wherein said firing button is located on the axis of rotation of said pivotable connection.

14. The closure and launcher of claim 13 wherein the means for effecting rotation of said carrier from said first to said second positions include a ready spring with its axis at said pivotable connection providing the motive power, a release lever, and a ready button to actuate said release lever upon depression of said ready button, releasing said carrier and allowing said ready spring to effect rotation of said carrier from said first confined position to said second open position.

15. The closure and launcher of claim 14 further including a safety device which allows said firing button to release said launching device to propel said vehicle only when said carrier is in said open position.

16. The closure and launcher of claim 15 further comprising a firing lever having a catch which engages said vehicle when said vehicle is loaded on said carrier holding said launching device and maintaining said launching spring in a cocked position, said firing button having a projection which will engage said firing lever only when said carrier is in its second open position, such projection and firing lever constituting said safety device.

17. A toy vehicle carrying closure and launcher comprising, in combination:

an elongate housing;

a vehicle carrier pivotably connected at one end of said housing for rotation from a first position in which the carrier is contained within said housing to function therewith as a carrying closure to a second position presenting an open end for launching said vehicle;

a ready spring with its axis at said pivotable connection and operatively connected between said carrier and said housing for effecting said rotation;

a release lever; a ready button which upon depression moves said release lever to release said carrier allowing said ready spring to rotate said carrier from said first confined position to said second open launching position;

a launching device operatively connected to said carrier;

means for aligning said vehicle on said carrier in operative relationship to said launching device;

a launching spring acting between said launching device and said carrier;

a firing button located on the axis of rotation of said pivotable connection movable against said ready spring to release said launching device allowing said launching spring to propel said vehicle.

18. The closure and launcher of claim 17 wherein said firing button has a projection which engages one end of said ready spring and an abutment surface which engages an abutment surface on said housing whereby as said carrier is moved from said second open launching position to said first confined position, said ready spring will be cocked and said ready release button will be operatively repositioned.

19. The closure and launcher of claim 18 further comprising a pivot lock spring on said carrier and a pivot lock abutment on said housing which engages to lock said carrier in said first position, and upon depression of said ready button, said lock spring disengages said lock abutment allowing said ready spring to rotate said carrier from said first confined position to said second open position.

20. The closure and launcher of claim 18 further comprising a firing lever having a catch which engages said vehicle when said vehicle is loaded on said carrier, holding said launching device and maintaining said launching spring in a cocked position, said projection on the firing button being in line with said firing lever only when said carrier is in said second open position effecting launching of said vehicle only when said firing button is depressed while said carrier is in said second open launching position.

21. The closure and launcher of claim 17 wherein said launching device has an impact panel, the forward side of which engages said vehicle and said operative connection to said carrier includes a pair of slide members projecting from the rear side of said impact panel and engaging stationary sliders on said carrier.

22. The closure and launcher of claim 21 wherein said launching spring is located between said slide members bearing against the rear side of said impact panel.

23. The closure and launcher of claim 21 wherein the means for aligning said vehicle on said carrier includes an alignment bar extending from the forward side of said impact panel, and said vehicle has wall means forming a longitudinally extending passageway for receiving said alignment bar as said vehicle is loaded on said carrier.

24. The closure and launcher of claim 23 further including a retractable belt clip mounted on the bottom surface of said housing at the end opposite said pivotable connection whereby as said housing is pressed on a roadway surface for launching, said clip will retract against said housing.

* * * * *